US008816943B2

(12) United States Patent
Kawabe

(10) Patent No.: US 8,816,943 B2
(45) Date of Patent: Aug. 26, 2014

(54) DISPLAY DEVICE WITH COMPENSATION FOR VARIATIONS IN PIXEL TRANSISTORS MOBILITY

(75) Inventor: Kazuyoshi Kawabe, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 595 days.

(21) Appl. No.: 13/123,696

(22) PCT Filed: Oct. 5, 2009

(86) PCT No.: PCT/US2009/005466

§ 371 (c)(1),
(2), (4) Date: Jul. 26, 2011

(87) PCT Pub. No.: WO2010/044827

PCT Pub. Date: Apr. 22, 2010

(65) Prior Publication Data

US 2011/0279049 A1 Nov. 17, 2011

(30) Foreign Application Priority Data

Oct. 16, 2008 (JP) ..... 2008-267708

(51) Int. Cl.
*G09G 3/30* (2006.01)

(52) U.S. Cl.
USPC ..... 345/77; 345/76; 345/211; 345/212; 345/690

(58) Field of Classification Search
None
See application file for complete search history.

(56) References Cited

U.S. PATENT DOCUMENTS

| | | | | |
|---|---|---|---|---|
| 6,229,506 | B1 | 5/2001 | Dawson et al. | |
| 6,348,906 | B1 | 2/2002 | Dawson et al. | |
| 6,618,030 | B2 | 9/2003 | Kane et al. | |
| 6,876,345 | B2 | 4/2005 | Akimoto et al. | |
| 7,830,342 | B2 | 11/2010 | Mutsukura et al. | |
| 7,880,695 | B2 | 2/2011 | Yamashita et al. | |
| 7,982,697 | B2 | 7/2011 | Kasai et al. | |
| 8,405,582 | B2 | 3/2013 | Kim | |
| 8,446,343 | B2 | 5/2013 | Akimoto et al. | |
| 2006/0066254 | A1 | 3/2006 | Sasaki et al. | |
| 2006/0139253 | A1* | 6/2006 | Choi et al. | 345/76 |
| 2006/0221028 | A1* | 10/2006 | Aoki | 345/88 |
| 2007/0273620 | A1 | 11/2007 | Yumoto | |
| 2008/0048955 | A1 | 2/2008 | Yumoto et al. | |
| 2008/0055299 | A1 | 3/2008 | Choi et al. | |

* cited by examiner

*Primary Examiner* — Joseph Haley
*Assistant Examiner* — Ifedayo Iluyomade
(74) *Attorney, Agent, or Firm* — Global OLED Technology LLC

(57) ABSTRACT

In order to efficiently execute threshold value compensation for a driving transistor, a coupling capacitor has one end connected to a data line. Another end of the coupling capacitor is connected to a selection transistor and one end of a reset transistor. A control terminal of a driving transistor is connected to the other end of the selection transistor, and an organic EL element is connected to this driving transistor via a light emission control transistor. A data voltage, corresponding to a gradation signal supplied to the data line, is written to a storage capacitor via the coupling capacitor, and with the selection transistor and the light emission control transistor in an off state and the reset transistor turned on, a compensation voltage corresponding to a degree of mobility of the driving transistor is written to the coupling capacitor.

8 Claims, 8 Drawing Sheets

DISPLAY DEVICE WITH COMPENSATION FOR VARIATIONS IN PIXEL TRANSISTORS MOBILITY

FIELD OF THE INVENTION

The present invention relates to a display panel with pixels, including current driven type light emitting elements, arranged in a matrix shape.

BACKGROUND OF THE INVENTION

Because an organic EL display that uses organic EL elements, being current driven light emitting elements, is of the self-emissive type, it has high contrast and fast response, making is suitable for moving picture applications such as a television for displaying natural images. Generally, an organic EL element is driven with a fixed current using a control element such as a transistor, but the transistor in that case is used in the saturation region. Therefore, even if the same gradation voltage is supplied, a different current is generated in each pixel due to variations in characteristics such as Vth (threshold voltage) and mobility of the transistors, making it difficult to maintain uniformity of emission brightness. In order to solve this problem, a structure having a circuit for compensating for Vth provided inside a pixel is disclosed in WO 98/48403

If the Vth correction circuit shown in FIG. 3 of WO 98/48403 is used, a gradation signal voltage is normally applied to the gate terminal of a drive transistor for supplying current to an organic EL element to offset that Vth. Vth of the drive transistor is therefore automatically corrected. However, it is also difficult to correct mobility of carriers such as electrons in the transistor with the Vth correction circuit of the related art disclosed in WO 98/48403, and it is difficult to ensure high brightness uniformity over a wide gradation range when there are variations in mobility between pixels.

SUMMARY OF THE INVENTION

The present invention is a display device, having pixels that are arranged in a matrix, and a driver for controlling potential of each line, wherein each pixel comprises:

a coupling capacitor having one end connected to a data line;

a selection transistor, having one end connected to the coupling capacitor, and which is switched ON and OFF by a selection line connected to a control terminal;

a driving transistor, having a control terminal connected to the other end of the selection transistor, and one end connected to a power supply;

an emission control transistor, having one end connected to another end of the driving transistor, and being turned ON and OFF by an emission control line;

a current driven type light emitting element connected to another end of the emission control transistor;

a storage capacitor which connects the control terminal of the driving transistor and the one end of the driving transistor that is connected to the power supply side; and a reset transistor that connects the emission control transistor side other end of the driving transistor and a selection transistor side other end of the coupling capacitor, and that is turned ON and OFF by a reset line, and wherein the driver writes a data voltage, corresponding to a gradation signal supplied to the data line, to the storage capacitor via the coupling capacitor, and with the selection transistor and the emission control transistor in an off state and the reset transistor turned on, writes a compensation voltage corresponding to mobility of the driving transistor to the coupling capacitor.

It is also possible for the current driven light-emitting element to be an organic EL element.

It is also possible for the driver to be capable of varying the time that the reset transistor is turned on with the selection transistor and the emission control transistors in an off state.

It is also possible for the driver to turn the emission control transistor on in a state where the selection transistor and the reset transistor are turned off, and after that turn the reset transistor on with the selection transistor and the emission control transistor turned off.

It is also possible for the driver to write a compensation voltage to the coupling capacitor in a state where the same gradation signal is supplied to all pixels, then turn off the selection transistor, turn on the emission control transistor and the reset transistor, and write a voltage corresponding to voltage lowering of the driving transistor to the coupling capacitor, and after that perform equalization processing for the current characteristics of the driving transistor by causing current to flow in the drive transistor based on a voltage at the coupling capacitor.

Since it is possible to carry out correction based on mobility of the driving transistor, high brightness uniformity can be ensured even in the event that there are variations in mobility between driving transistors of each pixel.

DESCRIPTION OF THE PREFERRED EMBODIMENTS

Embodiments of the present invention will be described in the following based on the drawings.

Figure 1:
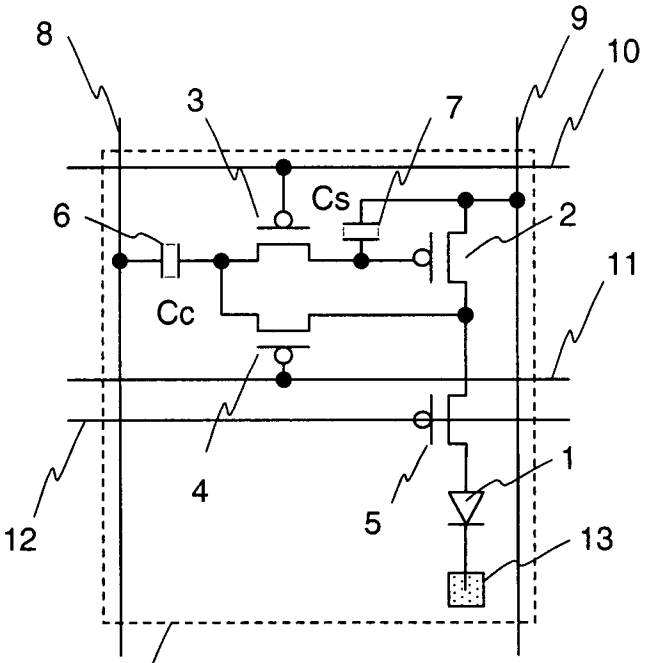
FIG. 1 is a drawing showing the structure of one example of a pixel circuit of the present invention.

The circuit structure for a pixel of this embodiment is shown in FIG. 1. In a pixel 14, an organic EL element 1 has a cathode connected to a cathode electrode 13 common to all pixels (for supplying a specified low voltage VSS), and an anode connected to a drain terminal of a light emission control transistor 5 having a gate terminal connected to a light emission control line 12. A source terminal of the light emission control transistor 5 is connected to a drain terminal of a driving transistor 2 having a source connected to a power supply line 9 common to all pixels (for supplying a specified high voltage VDD). A source terminal of a reset transistor 4 having a gate terminal connected to a reset line 11 is connected to a point of connection between the light emission control transistor 5 and the driving transistor 2. Also, a drain terminal of the reset transistor 4 is connected to one end of a coupling capacitor 6 having its other end connected to a data line 8, and to a drain terminal of a selection transistor 3 having its gate terminal connected to a selection line 10. The source terminal of the selection transistor 3 is connected to a gate terminal of the driving transistor 2 and to one end of a storage capacitor 7 that has its other end connected to the power supply line 9.

Here, a coupling capacitor 6 has a capacitance value Cc, and the storage capacitor 7 has a capacitance value Cs. It is preferable, in preventing reduction in dynamic range of a gradation signal voltage Vsig supplied to the data line 8, to make the capacitance value Cc of the coupling capacitor large compared to the capacitance value Cs of the storage capacitor. With this embodiment, by forming the coupling capacitor 6 crossing the data line 8 its capacitance Cc is sufficiently ensured.

Figure 2:
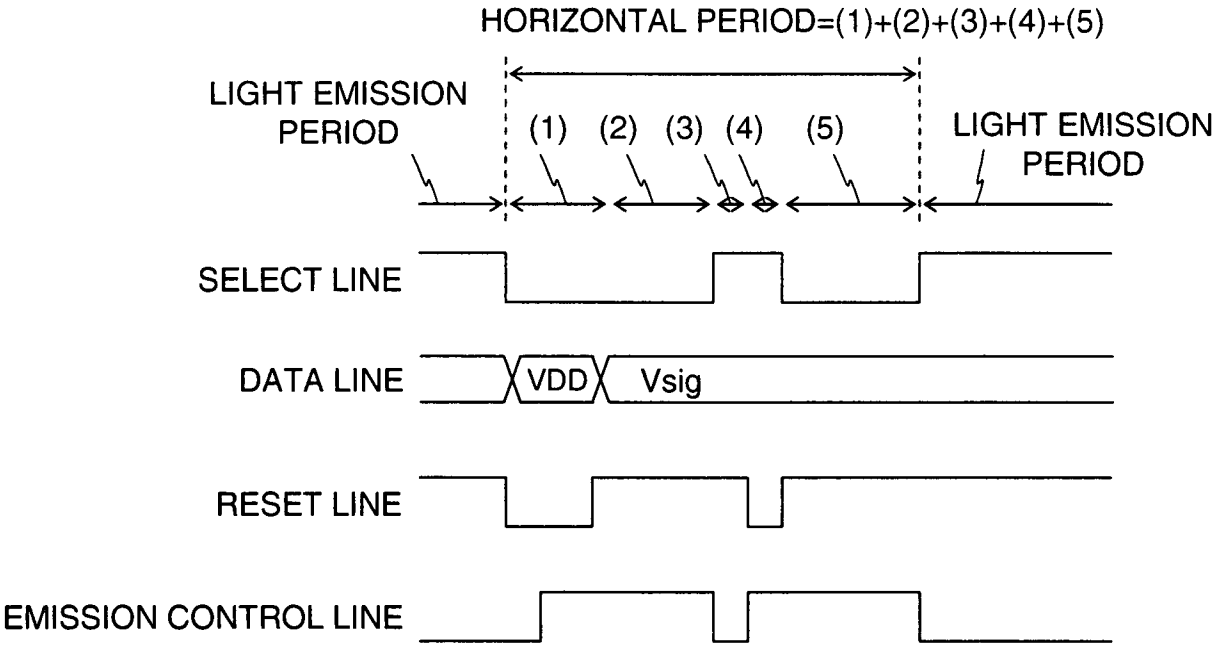
FIG. 2 is a timing chart showing an example of states of each line.

A control method for compensating Vth and mobility of the driving transistor 2 using the pixel 14 of FIG. 1 is shown in FIG. 2. As shown in FIG. 2, one horizontal period is divided into a reset period (1), a first data write period (2), a current supply period (3), a mobility compensation period (4), and a second data write period (5).

In a horizontal period for selecting a line of pixels 14, the selection line 10 is made Low to select the line of pixels. Here, in the reset period (1) in the first half of this horizontal period, the reset line 11 is made Low, the selection transistor 3 and the reset transistor 4 are turned on, and the drive transistor 2 is diode connected to enable current to temporarily flow in the organic EL element 1. After that, because the light emission control line 12 is made High and the light emission control transistor 5 is turned off, the current that was flowing in the organic EL element 1 is made to flow via the reset transistor 4 to the coupling capacitor 6 and storage capacitor 7. While this is happening the same power supply potential VDD as on the power supply line 9 is supplied to the data line 8, and so by the time a certain length of time has elapsed and current no longer flows, Vth is held at the coupling capacitor 6 and the storage capacitor 7. The reset transistor 4 is turned off by setting the reset line 11 High at this time, and the potential held at the coupling capacitor 6 and the storage capacitor 7 is settled, and the reset period (1) is completed.

After that, a transition is made to the first write period (2), and if the gradation signal potential Vsig is supplied to the data line 8, the gate source potential Vgs of the driving transistor 2 is controlled to Vgs={Cc/(Cc+Cs)}*Vsig+Vth with coupling by the coupling capacitor, and the gradation signal potential Vsig with Vth of the driving transistor 2 corrected is written. Next, by making the selection line 10 High, that potential is written to the storage capacitor 7 (above described Vgs is retained), and the first data write period (2) is completed. However, the previously described reset period does not have to continue until there is substantially no current flow in the driving transistor 2, and can be a length of time such as a few μs to a few tens of μs.

The capacitance Cc of the coupling capacitor 6 is sufficiently larger than the capacitance Cs of the storage capacitor 7, which shows that Cc/(Cc+Cs) is substantially equal to 1, and the dynamic range of the gradation signal potential Vsig is maintained.

If the reset period (1) and the first data write period (2) are complete, specifically, if Vth is compensated and the gradation signal potential Vsig has been written, there is a transition to the current supply period (3), where the light emission control line 12 is made Low and the light emission control transistor 5 is turned on. Therefore, drive current corresponding to the written gradation signal potential Vsig flows via the light emission control transistor 5 into the organic EL element 1. With the lapse of a comparatively short current supply period (3) the light emission control line 12 is made High, current flow is interrupted, and the current supply period (3) is completed.

Next, there is a transition to the mobility compensation period (4), where the reset line is made Low, and current that was flowing in the organic EL element 1 (mobility compensation current) flows via the reset transistor 4 to the coupling capacitor 6. At this time, a gradation signal potential being supplied to the data line 8 stays at Vsig.

At this time, if mobility of the driving transistor 2 is high, mobility compensation current is large, that is, the drain potential of the driving transistor 2 is increased, which shows that a higher potential is written to the coupling transistor 6, while in the case of low mobility the mobility compensation current is small and the drain potential of the driving transistor 2 is lowered, which shows that a lower potential is written.

If the reset line 11 is made High, the mobility compensation period (4) is completed, and a potential that has been compensated according to mobility difference is settled at the coupling capacitor 6.

After that, there is a transition to the second data write period (5), and if the selection line 10 is made Low and the second write period commences, the correction signal potential written to the coupling capacitor 6 is reflected at the gate terminal of the driving transistor 2, and by making the selection line 10 High a mobility corrected potential is written to the storage capacitor 7. The selection line 10 is then made High and the light emission control line 12 made Low, to complete the second data write period (5).

In this manner, in a single horizontal period where a line of pixels 14 are selected, data write to each pixel of that line is completed. Light emission is then carried out according to the compensated potential written to the storage capacitor 7 at this time, until writing is carried out in the next frame. Accordingly, display is carried out using a signal with Vth and mobility compensated.

If control is carried out in this way, the mobility compensation potential Vu is represented as Vu=Ids*Δt/Cc, using a rather short mobility compensation period Δt, and is proportional to drive current Ids and compensation period Δt. Also, using mobility u, gate capacitance per unit area Cox, and transistor size W, L, drive current Ids is expressed as $Ids=0.5*u*Cox*(W/L)*Vsig^2$ (provided Vth is compensated and CC is sufficiently larger than Cs.), and since it is proportional to mobility u, the mobility compensation potential Vu is dependent on mobility u, compensation period Δt and Vsig. Accordingly, after completion of the second write period the signal potential becomes Vgs={Cc/(Cc+Cs)}*Vsig+Vth−Ids*Δt/Cc, and an offset potential Vu corresponding to mobility and the gradation signal potential is subtracted from a potential with Vth compensated.

Figure 3:
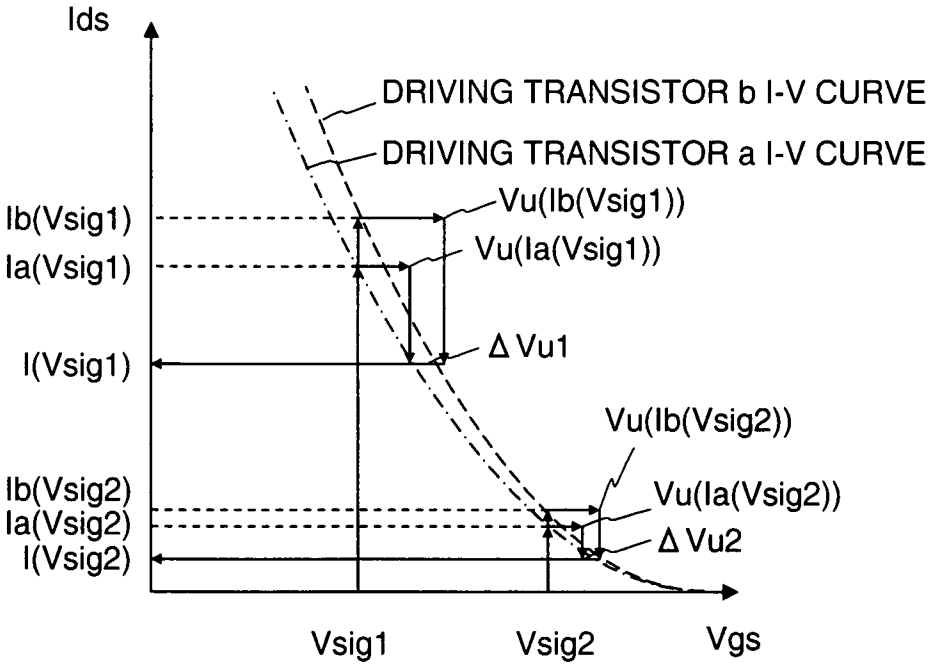
FIG. 3 is a drawing showing variation in I-V curve accompanying differences in mobility of a driving transistor.

The effect of this type of mobility compensation will be described using FIG. 3. FIG. 3 shows I-V curves for a driving transistor a and a driving transistor b with Vth compensated. If mobility differs, a difference in the inclination of the I-V curve arises between the transistors, and current flowing in the organic EL element 1 is different even if the same signal potential Vsig is applied. For example, even if Vsig1 is written to a pixel after Vth compensation, the transistor a and the transistor b with different mobility output respectively different drive currents of Ia(Vsig1) and Ib(Vsig1) to the organic EL element 1.

If the mobility compensation of this embodiment is adopted, a mobility compensated potential Vu corresponding to drive current Ids is subtracted from a potential across a gate and source with Vth compensated, which indicates that it is possible to make the drive current uniform. For example, if Vsig1 is written after compensation of Vth, with the transistor a current Ia(Vsig1) flows in the mobility compensation period, and with the transistor b current Ib(Vsig1) flows in the mobility compensation period, and these currents flow into the respective coupling capacitors 6 via the reset transistor 4. As shown in FIG. 3, driving transistor b with a more upright I-V curve has greater current mobility compensation current than transistor a, and mobility compensation potential Vu is larger. Specifically, since Vu(Ib(Vsig1))>Vu(Ia(Vsig1)), driving transistor b has a smaller gate source potential, and output current is constrained. As a result, after completion of mobility compensation, if a signal is again written to the storage capacitor 7 in the second write period the drive current output to the organic EL elements is substantially I(Vsig1), and differences in output current due to mobility of the driving transistors a and b are made uniform.

Even in the case of writing Vsig2 that generates a smaller driving current, mobility compensation is carried out on the same principle and made uniform. In the case of writing Vsig1, since the current I(Vsig1) that has been made uniform flows in the driving transistors a and b, a potential difference of ΔVu1=Vu(Ib(Vsig1))−(Vu(Ia(Vsig1)) is necessary, but in the case of Vsig2, this potential difference ΔVu2=Vu(Ib(Vsig2))−Vu(Ia(Vsig2)) is required to be smaller than ΔVu1. It is therefore necessary to adjust the potential difference ΔVu after compensation depending on the gradation signal potential Vsig, but with mobility compensation of the present invention, since mobility compensation potential Vu is automatically adjusted according to drive current Ids, namely Vsig, appropriate mobility compensation is carried out at all gradations.

Also, with the mobility compensation of this embodiment it is possible to vary the mobility compensation period Δt by either changing a pulse width input to the reset line 11 or inputting pulses a plurality of times etc., and it is possible to easily adjust the mobility compensation potential Vu. For example, by setting the mobility compensation period Δt long in the case of a panel with large variation in mobility, and setting the mobility compensation period Δt short with a panel having only slight variation in mobility, it is possible to avoid the drawbacks of insufficient or excessive compensation. Specifically, it is possible to realize an effective compensation amount for each panel by adjusting the mobility compensation period Δt. For example, it is possible to provide a register for setting Δt in a data driver and select driver, that will be described later, to write an externally supplied setting value for Δt in this register, and to carry out control in accordance with a value for Δt written to the register by the select driver at the time of mobility compensation.

Figure 4:
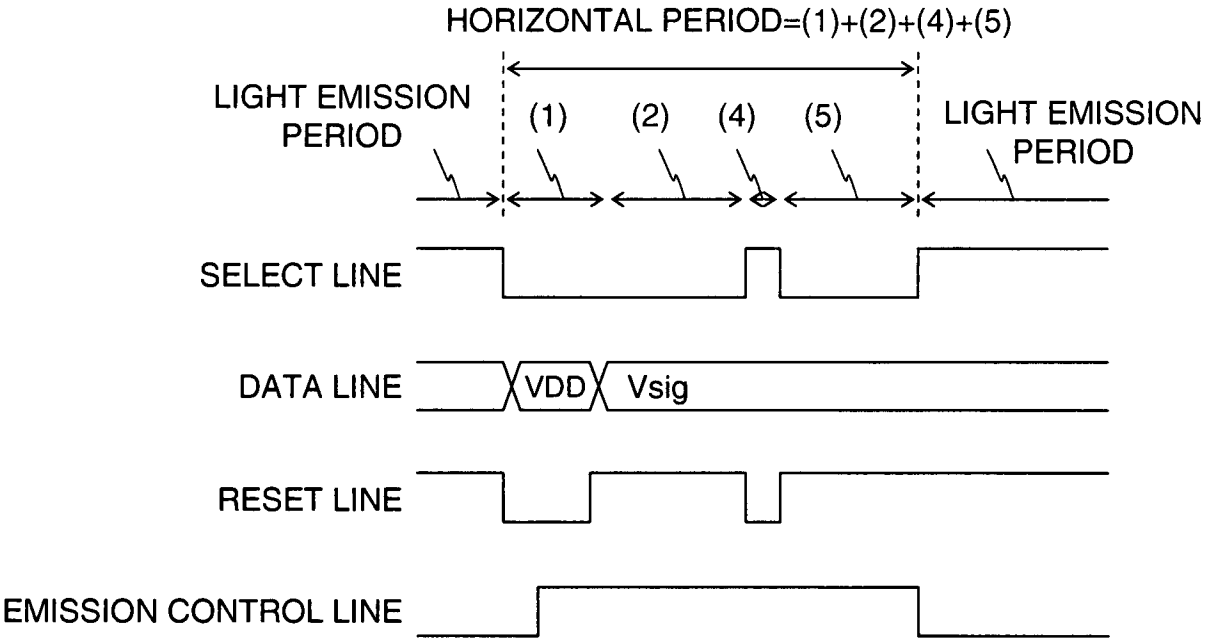
FIG. 4 is a timing chart showing another example of states of each line.

Another mobility compensation method using the pixels 14 of FIG. 1 is shown in FIG. 4. The power supply period (3) is omitted from FIG. 4. Specifically, once the gradation signal potential Vsig is written after Vth compensation, by making the reset line 11 Low with the light emission control line 12 still High, the mobility compensation current Ids is charged from the driving transistor 2 to the coupling capacitor 6.

The reason this type of control becomes possible is that immediately after making the reset line 11 Low, one terminal of the coupling capacitor 6 and the drain terminal of the driving transistor 2 are connected via the reset transistor 4, but the drain terminal of the driving transistor 2 is at substantially the same potential as the gate terminal, which indicates that the driving transistor is operated in the saturation region, and a mobility compensation current according to a difference in mobility flows. Accordingly, the mobility compensation potential Vu is represented as Vu=Ids*Δt/Cc, and mobility compensation according to gradation is realized. As the current supply period (3) can be omitted in this way, control is simplified and it is possible to efficiently utilize the horizontal period. For example, the second write period can be sufficiently ensured, and the horizontal period can be shortened, and image signal writing can be simplified even if there are a lot of lines.

Figure 5:
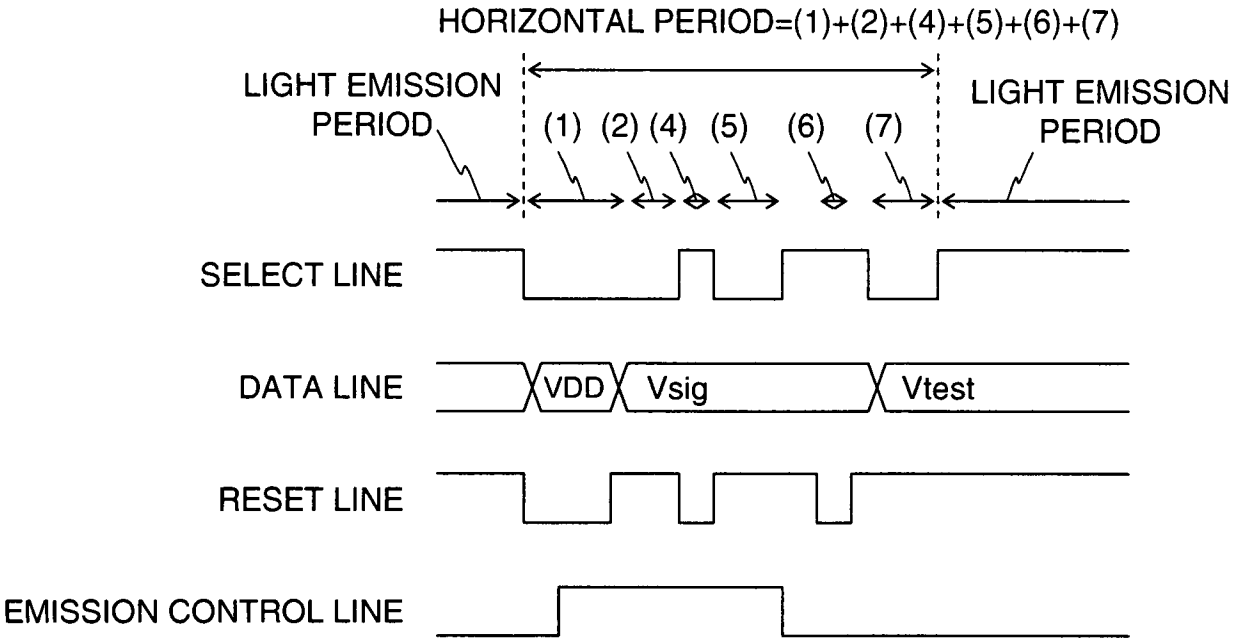
FIG. 5 is a timing chart showing a further example of states of each line.

Further, by using control such as that in FIG. 5 using the pixels 14, it becomes possible to make variations in brightness accompanying degradation of the organic EL elements 1 uniform. In FIG. 5, a drive voltage readout period (6) and a third write period (7) have been added to the horizontal period of FIG. 4.

First, Vth is compensated in the reset period, and after writing the gradation signal Vsig in the first write period mobility is compensated, and the description up to this point is the same as previously. At the time of this processing to make deterioration of the organic EL elements uniform, the same gradation pixel is supplied to all pixels.

In FIG. 5, after the second write period (5) there is a transition to the drive voltage readout period (6). The light emission control line 12 is made Low, and the organic EL element 1 temporarily emits light. At this time, current flowing in the organic EL element 1 is constant for each pixel, due to compensation of Vth and mobility of the driving transistor 2.

If the reset line 11 is set Low after waiting for the lapse of a specified time, the anode potential of the organic EL element 1 is written to one end of the coupling capacitor 6. While this is taking place, the other end of the coupling capacitor 6 is fixed at Vsig or another arbitrary potential. In this way, it is possible to read out an anode potential of the organic EL element at the time a fixed current flows, to the coupling capacitor 6.

The drive potential rises with elapse of time if the flow of current continues in the organic EL element. Specifically, if the same current flows in a deteriorated organic EL element, the drive voltage increases. The potential read out to the coupling capacitor 6 in the drive voltage readout period reflects the extent of deterioration of the organic EL element, and a higher voltage is read out for organic EL elements that suffer greater deterioration.

After that, if the reset line 11 is set High and the drive voltage readout period is completed, the selection line 10 is set low to commence the third write period (7), and the read out drive potential is reflected on the gate terminal of the drive transistor 2. At this time, Vtest is applied to the data line 8 in order to adjust the equalizing processing current, and an equalizing potential written to the storage capacitor 7 is adjusted using this adjustment potential Vtest to control current for the equalization processing.

If the selection line 10 is set High and the equalizing potential is written to the storage capacitor 7, a current corresponding to the equalizing potential flows in the organic EL element 1.

In pixels that have significant deterioration of the organic EL element, since a high drive potential is read out the potential Vgs across the gate and source of the driving transistor 2 becomes smaller, and equalizing current becomes smaller, but in pixels with only slight deterioration a low drive voltage is read out, and so the potential Vgs across the gate and source becomes larger and the equalizing current is increased. During equalization processing, a smaller current flows in those pixels with greater deterioration, while a larger current flows in those pixels with slight deterioration. Specifically, since pixels with only slight deterioration deteriorate rapidly, if the equalization process continues deterioration will become uniform across pixels. This equalization process can be carried out during non-use periods of the display. It is also possible for this equalization process to be carried out with a refresh rate of 60 Hz, the same as normal display, or to be carried out at a refresh rate that is different from that of normal display, such as a lower frequency of 30 Hz, for example. In this way a single horizontal period becomes longer, and it is made possible to sufficiently ensure the Vth compensation time and the deterioration potential readout time.

The pixel 14 of this embodiment uses P-type transistors for all transistors, but it is also possible to use N-type transistors in some sections, or to use all N-type transistors.

Figure 6:
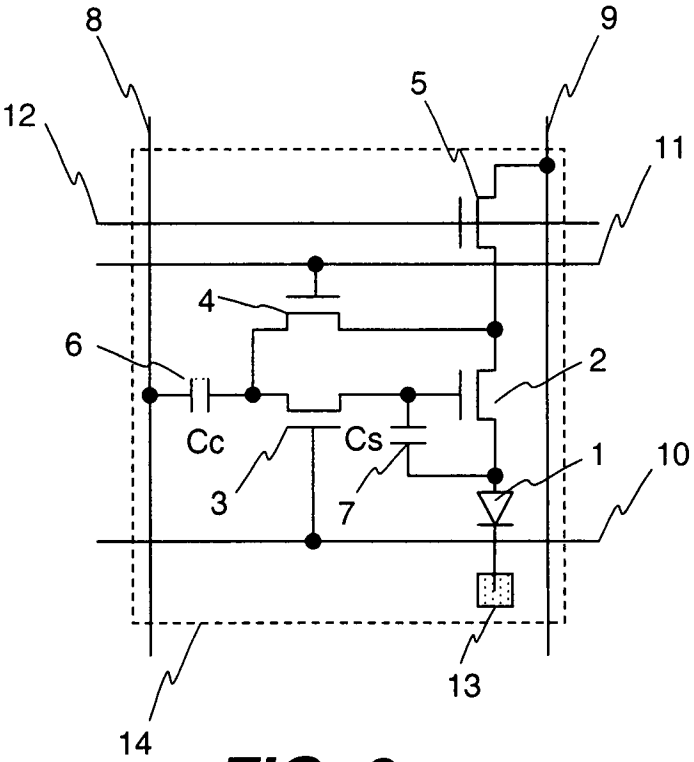
FIG. 6 is a drawing showing another example structure for a pixel circuit.

FIG. 6 is one example of the pixel 14 constructed with N-type transistors, and is controlled on the basis of FIG. 2 and FIG. 4. First, in the reset period an arbitrary potential, for example, a cathode potential VSS, is supplied to the data line 8, the selection line 10 is made high and the reset line 11 is made high, and the selection transistor 3 and the reset transistor 4 are turned on, and by diode connecting the driving transistor 2 current temporarily flows in the organic EL element 1. Then, the light emission control line 12 that was High is made Low, and the light emission control transistor 5 is turned off to write Vth of the driving transistor 2 to the coupling capacitor 6 and the storage capacitor 7. In the case of the pixel 14 of FIG. 6, the potential written to the coupling capacitor 6 and the storage capacitor 7 is not strictly speaking Vth of the driving transistor 2, but can be considered to reflect substantially Vth. Next, if the reset line 11 is set Low to turn the reset transistor 4 off and there is a transition to the first write period, a signal potential Vsig is supplied to the data line 8, and a signal potential Vsig with Vth compensated is written to the storage capacitor 7. After that, the selection line 10 is set Low, and if the reset line 11 is set High and the reset transistor 4 is turned on in order to carry out mobility compensation a current corresponding to the gradation signal Vsig flows from the driving transistor 2 operated in the saturation region through the reset transistor 4 to discharge the coupling capacitor 6. The discharge amount is dependent on the mobility of the driving transistor 2, and so a potential having the mobility compensated is generated at the coupling capacitor. If the reset line 11 is set Low, the reset transistor turned off and the selection line 10 again set High, the select transistor 3 is turned on and the gradation potential with mobility compensated is written to the storage capacitor 7 and that potential is held by setting the select line to Low. Following that, by setting the light emission control line 5 High, a current with Vth and mobility compensated flows in the organic EL element 1, and the organic EL element emits light. That is, the mobility compensation of the present invention also acts efficiently if N-type transistors are used.

Figure 7:
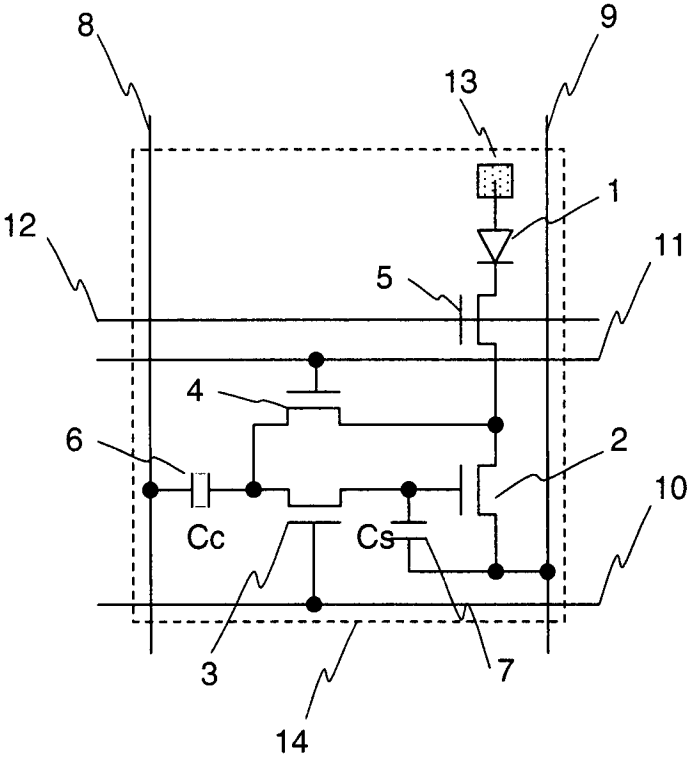
FIG. 7 is a drawing showing yet another example structure for a pixel circuit.

However, since it is difficult to read out the drive potential of the organic EL element 1 with the pixel 14 of FIG. 6, in the case of using N-type transistors it is desirable to have the pixel structure of FIG. 7.

FIG. 7 shows the pixel 14 with the anode of the organic EL element 1 made common. Therefore, VDD is supplied to the anode 13 while VSS is supplied to the power supply line 9. Control of the pixel 14 can use the same method as in FIG. 2 and FIG. 4, but the polarities of pulses input to the selection line 10, reset line 11 and emission control line 12 are reversed. In the reset period, while VSS is being supplied to the data line 8, the selection line 10 and reset line 11 are made High, and the selection transistor 3 and the reset transistor 4 are turned on to diode connect the driving transistor 2. At this time current temporarily flows in the organic EL element 1, but by making the light emission control line 12 Low and turning the light emission control transistor 5 off, Vth of the driving transistor 2 is written to the coupling capacitor 6 and the storage capacitor 7. Continuing on, in the first write period the select line is made High to keep the select transistor 3 turned on, the reset line 11 is made Low to turn the reset transistor 4 off, and the gradation signal Vsig supplied to the data line 8 is written to the storage capacitor 7, before a transition to the mobility compensation period. In the mobility compensation period the reset line 11 is made High to turn the reset transistor 4 on, and mobility compensation current Ids flows from the driving transistor 2, that is operated in the saturation region, to the coupling capacitor 6, and a potential corresponding to mobility and the gradation signal potential Vsig is generated. By turning the reset transistor 4 off, this compensation potential is held at the coupling capacitor 6, and in the second write period if the selection line 10 is again set High to turn the selection transistor 3 on then the compensation potential held at the coupling capacitor 6 is written to the storage capacitor 7. If the select transistor 3 is turned off and the light emission control transistor 5 is turned on, current flows in the organic EL element 1.

In the case of making deterioration in the organic EL elements uniform, with the control method shown in FIG. 5 the previously described Vth and mobility compensation are carried out, and it is possible to write a drive voltage of the organic EL element 1 with flow of equalized current in the organic EL element 1, into the coupling capacitor 6. Specifically, by making the reset line 11 High and turning the reset transistor 4 on, the drive potential is written to the coupling capacitor 6. Since the drive voltage is large for a severely deteriorated organic EL element, the cathode potential is low, while for a slightly deteriorated organic EL element the drive voltage is low and so the cathode potential is high. If the reset line 11 is set Low and the reset transistor 4 is turned off, this drive potential is temporarily held at the coupling capacitor 6, and if the selection line 10 is again made High to turn the selection transistor 3 on, this read out drive potential is then reflected at the gate terminal of the driving transistor 2. That is, in the case of a lot of deterioration, the potential Vgs across the gate and source of the driving transistor 2 is small, and equalizing current becomes small, while in the case of only slight deterioration the potential Vgs across the gate and source of the driving transistor is large and equalizing current becomes large. If the selection line 10 is made Low and the selection transistor 3 is turned off, equalizing current flows in the organic EL element 1 until the next selection of the selection line 10.

During equalization processing, a smaller current is supplied to those pixels with greater deterioration, while a larger current is supplied to those pixels with slight deterioration, thus facilitating equalization. Similarly to FIG. 5, the equalization current can be adjusted using Vtest supplied to the data line 8. When it is desired to perform equalization more rapidly, it is preferable to increase equalization current by adjusting Vtest, and in the case where it is desirable for display of equalization processing to not be noticeable it is preferable to perform equalization processing with a low current.

In this manner, even in the case where the pixels 14 are constructed using N-type transistors, it is possible for the Vth and mobility compensation of FIG. 2 and FIG. 4, and the equalization processing for deterioration of the organic EL element, to be carried out in the same way as for the case where the pixels 14 are constructed of P-type transistors. Also, with the above described example, for P-type or N-type, fixed potentials of VDD and VSS are supplied to the data line 8 in the reset period, and then Vth is compensated with Vsig supplied in the first write period, but it is also possible to reverse this. That is, it is possible to supply Vsig onto the data line 8 in the reset period, and supply a fixed potential constituting Vref in the first write period. If this is done, control is carried out so as to write a difference between Vsig and Vth to the coupling capacitor 6 in the reset period, and commence flow of current to the driving transistor 2 when the potential of the data line 8 becomes Vsig. Accordingly, if Vref is written in the first write period, a difference between Vref and Vsig is reflected at the gate of the driving transistor 2, and added to Vth, and so Vth is compensated. Next, in the mobility compensation period, the selection transistor 3 and the light emission control transistor 5 are kept off, and the reset transistor 4 is turned on, to write a difference in mobility to the coupling capacitor 6 as a potential difference. In the second write period, this potential is written to the storage capacitor 7 to carry out mobility compensation. In this way, mobility compensation of this embodiment is utilized efficiently, even if the Vth compensation method is different.

Figure 8:
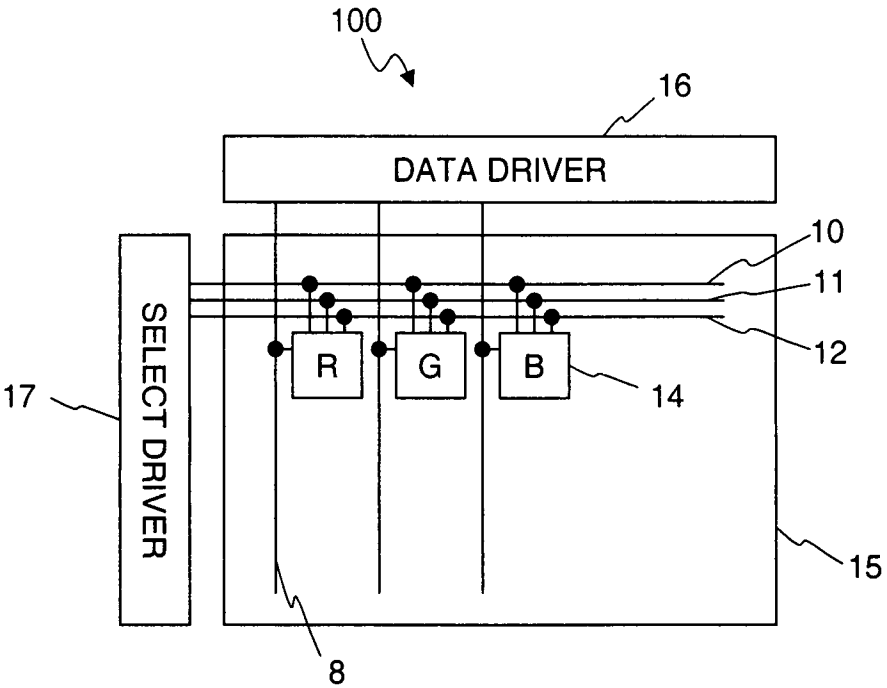
FIG. 8 is a drawing showing the overall structure of a display device.

FIG. 8 shows the overall structure of an organic EL display 100 formed from an array of the pixels 14 of the present invention. The organic EL display 100 includes a pixel array 15 having pixels 14 arranged in an array on a glass substrate or plastic substrate etc., a data driver 16 for driving data lines 8, and a selection driver 17 for driving select lines 10, reset line 11, and emission control lines 12. However, power supply lines 8 and cathode electrodes 13 that are common to all pixels are omitted from the drawing. In a pixel array 15, an example of full-color pixels is shown formed from R (red) G (green) and B (blue) sub-pixels, but it is also possible to have a structure where W (white) is added to give full-color pixels of RGBW.

The data driver 16 converts image data that has been transferred in dot units from an external section to line unit data using a shift register or the like, and outputs an analog signal potential in line units to the data line 8 by way of digital to analog conversion. In a reset period, in order to write Vth, VDD and VSS signal potentials are output, but in the write period a gradation signal potential Vsig is supplied. As a result of this Vth and mobility compensation are carried out in units of one line. The selection driver 17 has three outputs per one line, specifically output to drive the select lines 10, output to drive the reset lines 11, and output to drive the light emission control lines 12, but the respective lines are selectively driven to be made High or Low at the timing of FIG. 4 and FIG. 5. The data driver 16 and the selection driver 17 can be formed from elements such as low temperature polysilicon on the same substrate as the pixels 14, or can be provided as driver ICs with the outputs of these ICs connected to each of the lines. From the structure of FIG. 8, Vth compensation and mobility compensation, and also equalization of deterioration of the organic EL elements, is carried out efficiently in the pixels 14.

The structure of this embodiment can be used not only with organic EL elements, but with any other display device that uses current driven type light emitting elements.

Parts List

1 organic EL element
2 driving transistor
3 selection transistor
4 reset transistor
5 light emission control transistor
6 coupling capacitor
7 storage capacitor
8 data line
9 power supply line
10 selection line
11 reset line
12 control line
13 cathode electrode
14 pixel
15 pixel array
16 data driver
17 selection driver
100 organic EL display

The invention claimed is:

1. A display device having power supply, including:

pixels arranged in a matrix from, each pixel comprising:

a coupling in one end connected to a data line;

a selection transistor, having one end connected to the coupling capacitor, and which is switchable between ON and OFF states by a selection line connected to a control terminal of the selection transistor;

a driving transistor, having a control terminal connected to the other end of the switching transistor, and one end connected to the power supply;

a light emission control transistor, having one end connected to another end of the driving transistor, and being turned ON and OFF by a light emission control line;

a current driven type light emitting element connected to another end of the light emission control transistor;

a storage capacitor which connects a control terminal of the driving transistor and the one end of the driving transistor that is connected to the power supply side; and a reset transistor that connects (i) the one end of the light emission control transistor that is connected to the another end of the driving transistor to (ii) the one end of the selection transistor that is connected to the coupling capacitor, and that is turned ON and OFF by a reset line; and a driver for controlling potential of each line;

wherein, following (a) the driver writing a data voltage, corresponding to a gradation signal supplied to the data line, to the storage capacitor via the coupling capacitor, and with (b) the selection transistor and the light emission control transistor in an off state and the reset transistor turned on, thereby (c) a compensation voltage according to mobility of the driving transistor is developed on the coupling capacitor; and wherein further, with (d) the compensation voltage developed on the coupling capacitor in a state where the same gradation signal is supplied to all pixels, the driver then (e) turns off the selection transistor, and turns on both the light emission control transistor and the reset transistor, causing (f) a second voltage to be developed on the coupling capacitor that corresponds to a voltage increase across the light emitting element following which the driver (g) performs equalization processing by causing current to flow in the driving transistor based on the second voltage.

2. The display device of claim 1, wherein the current driven type light emitting elements are organic EL elements.

3. The display device of claim 1, wherein the driver is capable of varying the time that the reset transistor is turned on with the selection transistor and the light emission control transistors in an off state.

4. The display device of claim 3, wherein
the current driven type light emitting elements are organic EL elements.

5. The display device of claim 1, wherein
the driver turns the light emission control transistor on in a state where the selection transistor and the reset transistor are turned off, and after that turns the reset transistor on with the selection transistor and the light emission control transistor turned off.

6. The display device of claim 5, wherein
the current driven type light emitting elements are organic EL elements.

7. The display device of claim 5, wherein
the driver is capable of varying the time that the reset transistor is turned on with the selection transistor and the light emission control transistors in an off state.

8. The display device of claim 7, wherein
the current driven type light emitting elements are organic EL elements.

* * * * *